United States Patent [19]

Chmela

[11] 4,013,086

[45] Mar. 22, 1977

[54] COMBING DEVICE

[76] Inventor: John F. Chmela, 1106 Beechwood Drive, Mount Prospect, Ill. 60056

[22] Filed: Oct. 14, 1975

[21] Appl. No.: 621,657

[52] U.S. Cl. ..... 132/110; 132/11 R

[51] Int. Cl.[2] ..... A45D 24/16

[58] Field of Search ..... 132/11, 108–109, 132/129–131, 132, 142, 151, 158, 101

[56] References Cited

UNITED STATES PATENTS

| | | | |
|---|---|---|---|
| 2,437,298 | 3/1948 | Heyman | 132/110 |
| 2,664,092 | 12/1953 | Benco | 132/142 |
| 2,797,695 | 7/1957 | Fortmann | 132/110 |
| 3,424,174 | 1/1969 | Battaglia | 132/11 R |
| 3,595,248 | 7/1971 | Wright | 132/11 R |
| 3,792,707 | 2/1974 | Tupper | 132/11 R |
| 3,814,112 | 6/1974 | Tupper | 132/11 R |

FOREIGN PATENTS OR APPLICATIONS

| | | | |
|---|---|---|---|
| 194,901 | 2/1908 | Germany | 132/129 |
| 20,786 | 1899 | United Kingdom | 132/132 |

*Primary Examiner*—G.E. McNeill

*Attorney, Agent, or Firm*—Dominik, Knechtel, Godula & Demeur

[57] ABSTRACT

A combing device is provided which has a comb having a number of teeth, the comb being separable along the longitudinal axis thereof so as to be formed by a pair of complementary comb members of a substantially like construction. An insert of an absorbent material is removably retained between the pair of complementary comb members, and the insert extends laterally from the sides of the respective ones of the teeth and is discontinuous between adjacent pairs of the teeth so as to permit the combing device to be combed through the hair and to provide wiping surfaces between adjacent pairs of the teeth for engaging and thereby conditioning the hair as the combing device is combed through the hair. In addition, means are provided for releasably securing the pair of complementary comb members together with the insert therebetween.

28 Claims, 11 Drawing Figures

10
11
27
28
16
11
5
29
12
14
37
13
5
16

15
19
20
18b
17
12
18a
13
14
13

FIG. 4
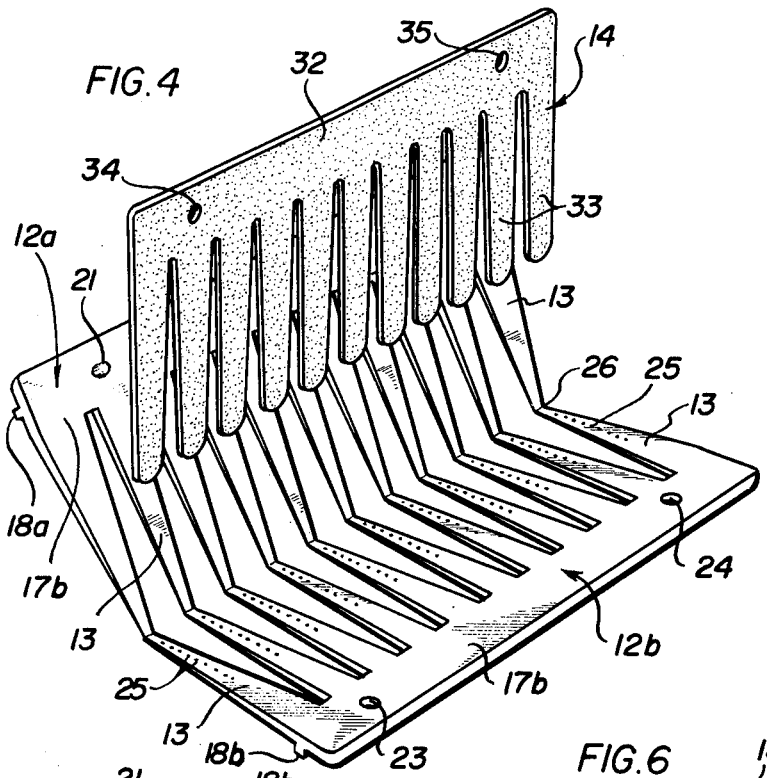
FIG. 5
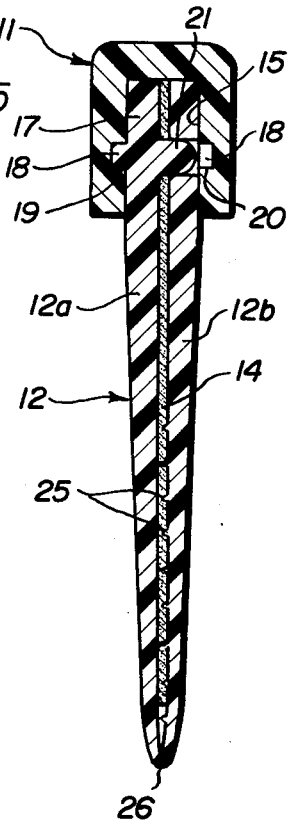
FIG. 6
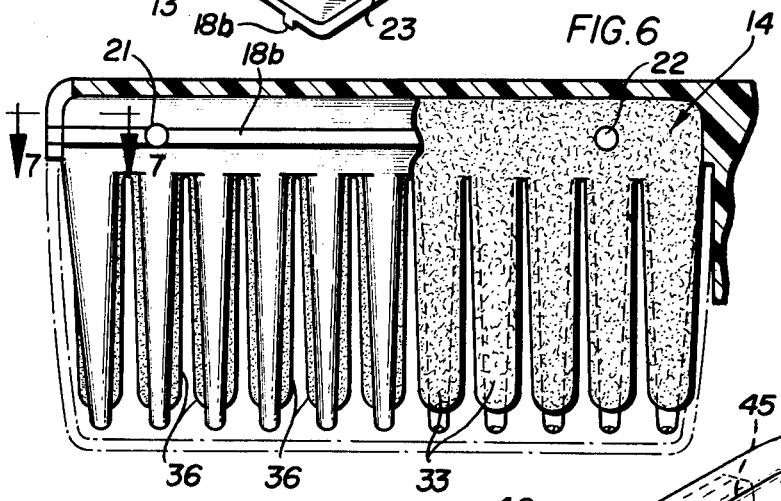
FIG. 8
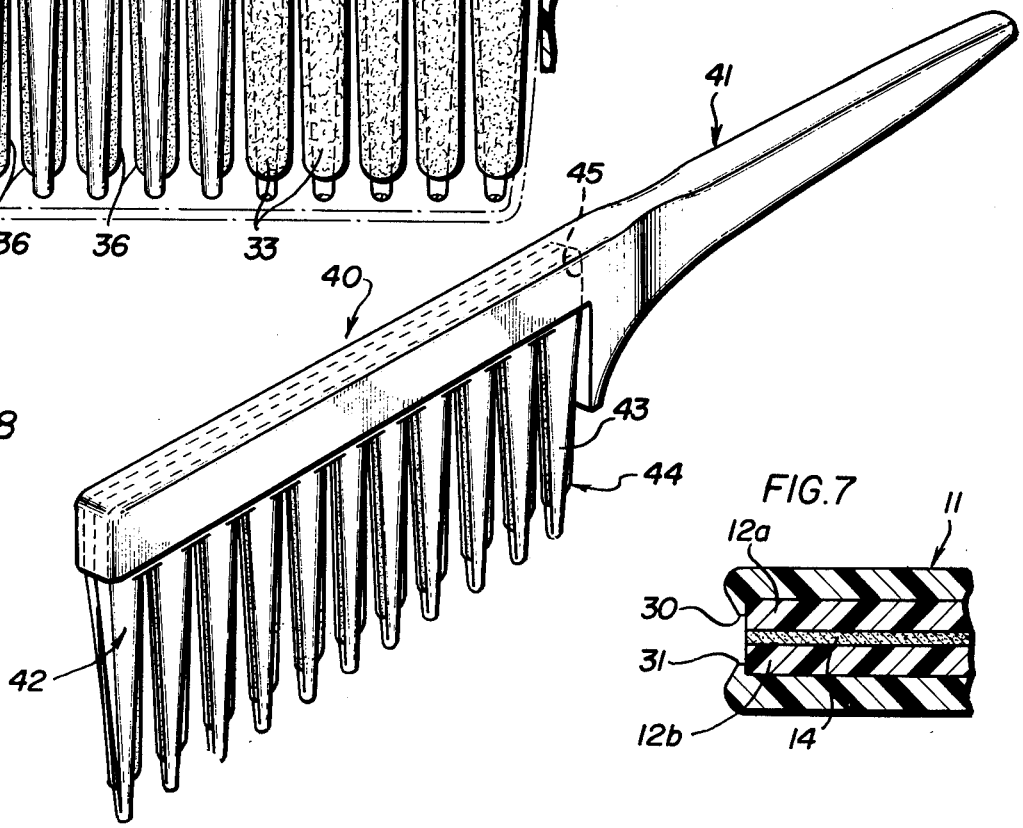
FIG. 7

COMBING DEVICE

BACKGROUND OF THE INVENTION

This invention relates to an improved combing device and, in particular, to an improved combing device for conditioning the hair as the combing device is combed through the hair.

More particularly, the combing device of the present invention is particularly applicable for cleansing and otherwise conditioning the hair, and for applying and removing from the hair various different substances, such as, for example, dry shampoo. In the latter case, the combing device is combed through the hair to remove the dry shampoo. A device generally applicable for the same purposes as the combing device of the present invention is disclosed in U.S. Pat. No. 3,833,008. In this latter patent, an applicator for the hair is disclosed which is in the form of a brush of a generally conventional construction and a removable pad.

OBJECTS OF THE INVENTION

Accordingly, it is an object of the present invention to provide a new and improved combing device for conditioning the hair.

Other objects and advantages will appear from the following description in conjunction with the accompanying drawings.

BRIEF DESCRIPTION OF THE DRAWINGS

FIG. 4 is a perspective view of the comb and the removable replaceable insert, with the comb being illustrated as formed in accordance with a preferred embodiment of the invention;

FIG. 5 is a sectional view taken substantially along lines 5—5 of FIG. 2;

FIG. 6 is a partial sectional view of the comb disposed within the handle portion;

FIG. 7 is a partial sectional view generally illustrating the flanges formed on the end of the handle for removably lockingly retaining the comb in the handle;

FIG. 8 is a perspective view of the combing device formed in accordance with a second embodiment of the invention;

Similar reference characters refer to similar parts throughout the several views of the drawings.

BRIEF SUMMARY OF THE INVENTION

In accordance with the invention, a combing device is provided which has a comb having a number of teeth, the comb being separable along the longitudinal axis thereof so as to be formed by a pair of complementary comb members of a substantially like construction. An insert of an absorbent material is removably retained between the pair of complementary comb members, and the insert extends laterally from the sides of the respective ones of the teeth and is discontinuous between adjacent pairs of the teeth so as to permit the combing device to be combed through the hair and to provide wiping surfaces between adjacent pairs of teeth for engaging and thereby conditioning the hair as the combing device is combed through the hair. In addition, means are provided for releasably securing the pair of complementary comb members together with the insert therebetween.

DETAILED DESCRIPTION OF THE INVENTION

Figures 1, 2, 3:
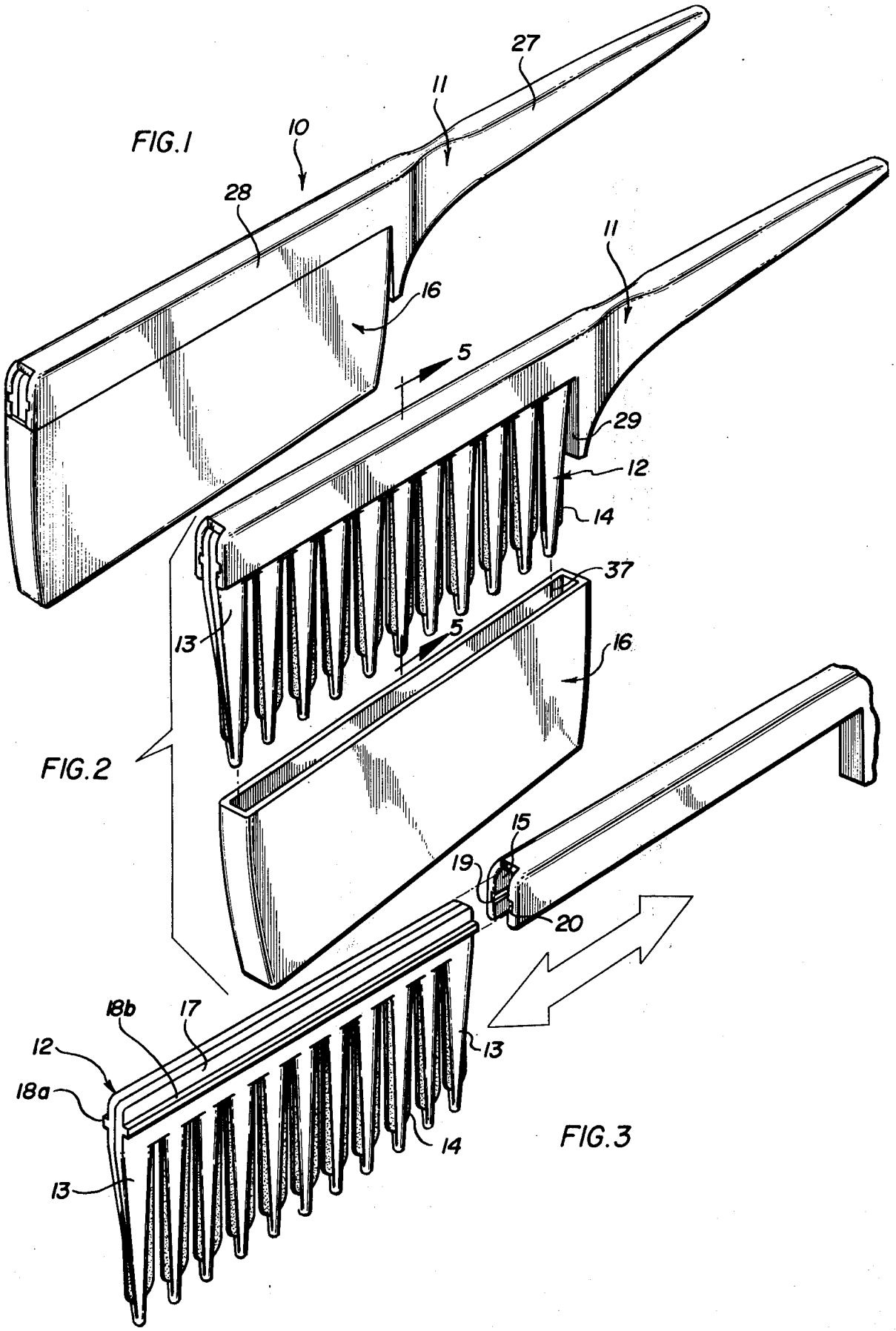
FIG. 1 is a perspective view of a combing device including a protective cover, constructed in accordance with a first embodiment of the invention.
FIG. 2 is an exploded perspective view of the combing device of FIG. 1, with the protective cover thereof removed.
FIG. 3 is a partial perspective view of the combing device of FIG. 1, illustrating the manner in which the comb is slidably received in and removed from the handle portion.

Referring now to the drawings, in FIG. 1 there is shown a combing device 10 formed in accordance with one embodiment of the invention. The combing device 10 includes a handle 11, with a comb 12 which is removably secured to the handle 11. The combing device 10, in addition, advantageously includes a cover 16 for protectively receiving therein the teeth 13 of the comb 12. The comb 12, as more specifically described below, is separable along the longitudinal axis thereof so as to be formed by a pair of complementary comb members **12*a* and 12*b* of a substantially like construction. An insert 14 of an absorbent material is removably retained between the pair of complementary comb members 12*a* and 12*b* forming the comb 12. In the embodiment illustrated in FIGS. 1–6 of the drawings, the comb 12 is removably retained within a cavity 15 formed in the handle 11, which cavity 15 functions to both secure the comb 12 to the handle 11 and to releasably secure the pair of complementary comb members 12*a* and 12*b* together with the insert 14** between them.

In the embodiment illustrated in FIG. 1, the terminal end of the cavity 15 is opened, and the comb 12 is slidably received within the cavity 15 through this open end, as illustrated in FIG. 3. The comb 12 is preferably and advantageously guided into the cavity 15, by means of a tongue and groove arrangement. In this particular case, an alignment tongue **18*a* and 18*b* is formed on a body portion 17 of the respective comb members 12*a* and 12*b*, and these alignment tongues are slidably received within alignment grooves 19 and 20 provided in the cavity 15 in the handle 11. Obviously, the tongue and groove arrangement can be reversed, with the alignment groove being provided in the comb and the tongue provided in the cavity 15 or, alternatively, other similar arrangements for guiding the comb 12 into the cavity 15 can be provided. Also, opposed inwardly extending locking flanges 30 and 31 preferably and advantageously are provided on the open end of the cavity 15, as illustrated in FIG. 7, to releasably lock the comb 12 in the cavity 15. Obviously, other types of locking means also can be utilized, such as, for example, a detent arrangement which will function to releasably lock the comb 12 in the cavity 15**.

As can be best seen in FIGS. 4, 5 and 6, one of the complementary comb members **12*a* and 12*b* forming the comb 12 preferably and advantageously has a pair of alignment pins 21 and 22** formed thereon which are receivable within apertures 23 and 24 formed in the other one thereof for fitting the comb members 12*a* and 12*b* together in aligned cooperative relationship with one another. The alignment pins 21 and 22 can be slightly larger in diameter than the apertures 23 and 24, so that the alignment pins 21 and 22 are frictionally received within the apertures 23 and 24 to releasably secure the pair of complementary comb members 12*a* and 12*b* together with the insert 14 between them.

The insert 14 has correspondingly positioned apertures 34 and 35 for receiving the alignment pins 21 and 22 for positioning and aligning the insert 14 in cooperative relationship with the comb members 12*a* and 12*b*. Also, the teeth 13 on at least one of the complementary comb members 12*a* and 12*b* preferably and advantageously have barb-like members 25 provided thereon for piercing or otherwise gripping the fingers or teeth 33 of the insert 14 for securing the fingers or teeth 33 in aligned functional relationship with the teeth 13 of the comb 12.

The insert 14, as indicated above, is of an absorbent material preferably of a non-woven material, however, the insert 14 can be of any woven, non-woven type material, and even tissue paper and the like, which is capable of absorbing or otherwise removing oil, dirt, grime, dry shampoo and other like substances from the hair to condition it. The insert 14 can be simply a generally rectangular sheet of material substantially coextensive with the overall area of the comb 12, with the insert 14 being slit or cut between adjacent pairs of the teeth 13 so as to permit the comb 12 to be combed through the hair and to provide wiping surfaces between adjacent pairs of teeth for engaging and thereby conditioning the hair as the combing device is combed through the hair. Alternatively, however, the insert 14 is die-cut or otherwise formed so as to substantially conform with the configuration of the comb 12, with the fingers or teeth 33 thereof being substantially coextensive with the length of the teeth 13 of the comb 12 and with the fingers or teeth 33 thereof of a width such as to extend laterally from the sides of the respective ones of the teeth, as can be best seen in FIG. 6, to provide wiping surfaces 36 between adjacent pairs of the teeth.

In the embodiment of the invention illustrated in FIGS. 1–6, the handle 11 includes a hand grip portion 27 and a body portion 28 in which the cavity 15 is formed. The protective cover 16 is formed with a cavity 37 for receiving therein the teeth 13 of the comb 12, to protectively enclose the teeth 13. The cover 16 can be merely frictionally removably secured to the comb 12, for easy removal and replacement.

While the combing device 10 can be of any type of material, preferably and advantageously it is molded of a plastic material. The comb members 12*a* and 12*b* forming the comb 12 can be two independent members which can be affixed together with the insert 14 therebetween, either by means of the alignment pins 21 and 22 being frictionally and releasably lockingly received within the apertures 23 and 24 or, alternatively, the complementary comb members 12*a* and 12*b* can be merely aligned in cooperative relationship with one another with the insert 14 therebetween and the two releasably secured together by slidably extending them into the cavity 15 in the handle 11, as described above. Further still, preferably and advantageously the complementary comb members 12*a* and 12*b* forming the comb 12 are molded of a plastic material with the terminal ends of the teeth 13 thereof being integrally affixed together by means of a molded flexible web or hinge 26, as illustrated in FIG. 4. With such a construction, the complementary comb members 12*a* and 12*b* are merely pivotally manipulated, or folded, together to secure the insert 14 therebetween, in the manner described above.

In FIG. 8, there is illustrated another combing device 40 constructed in accordance with a second embodiment of the invention. The combing device 40 is like the combing device 10 and has a handle 41 and a comb 12 having teeth 43. An insert 44 of an absorbent material is removably retained between the complementary comb members forming the comb 42, as described above. The combing device 40 differs from the combing device 10 in that the comb 42 is removably retained within a cavity 45 formed in the handle 41. In this case, the cavity 45 is a closed cavity, that is, the terminal end of the cavity is not opened as in the case of the cavity 15 in the handle 11 of the combing device 10. The comb 42, in this embodiment, is merely frictionally removably received within the cavity 45, and is removed and replaced merely by exerting sufficient force on the comb 42 to forcibly insert and remove the comb 42 from the cavity 45. In all other respects, the combing device 40 is like the combing device 10.

Figure 9:
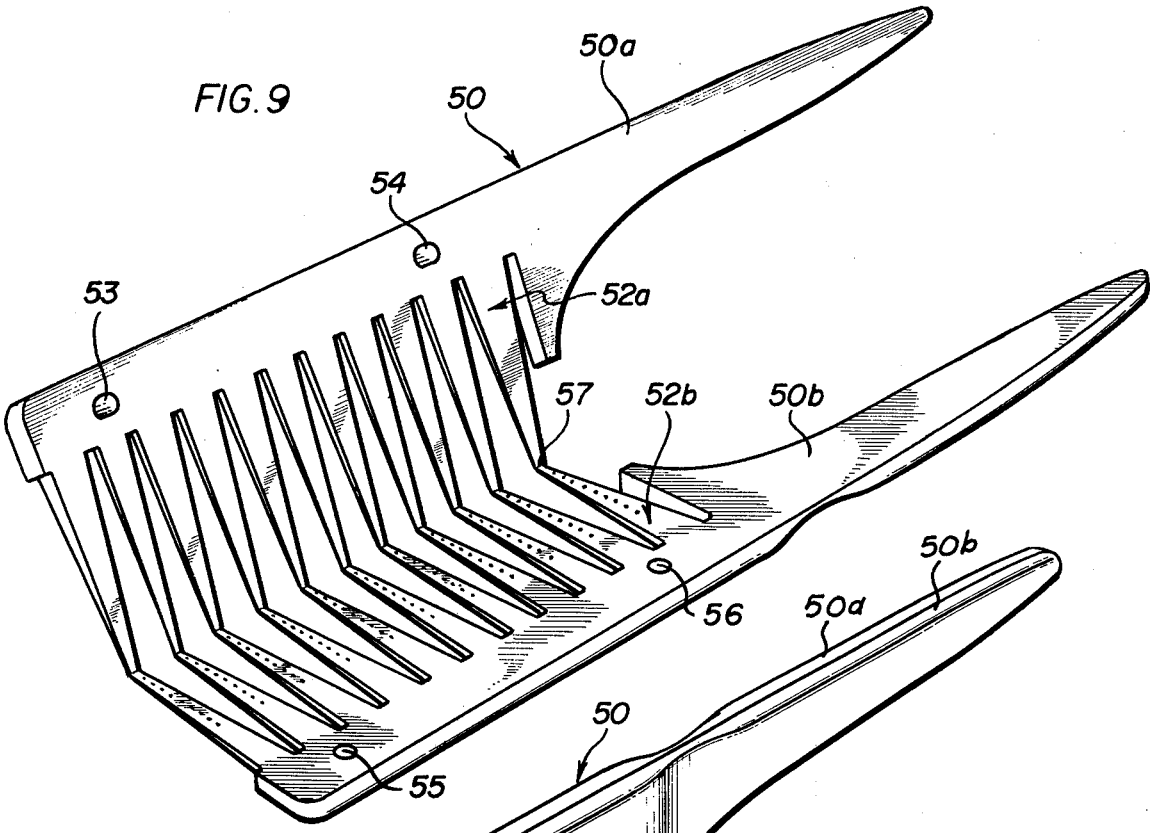
FIG. 9 is a sectional view of the combing device formed in accordance with still another embodiment of the invention.
Figure 10:
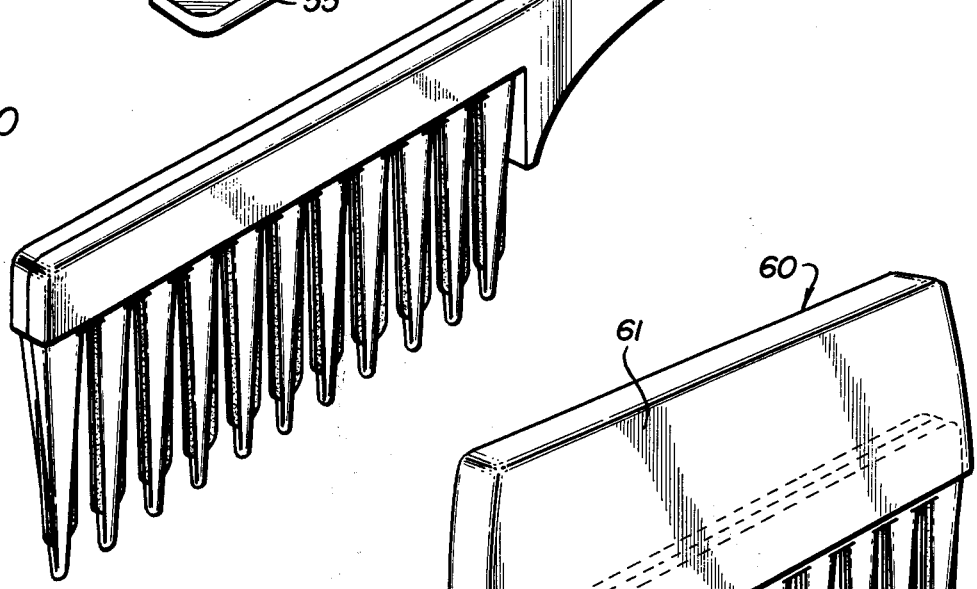
FIG. 10 is perspective view generally illustrating the combing device of FIG. 9 assembled, with the insert retained therein.

In FIGS. 9 and 10, there is illustrated still another combing device 50 formed in accordance with still another embodiment of the invention. In this case, the combing device 50 is formed of two complementary comb members 50*a* and 50*b*, each of which essentially comprises one half of the entire combing device in that the comb and the handle both are longitudinally separable. As in the cases described above, a pair of alignment and locking pins 53 and 54 are provided on one of the complementary comb members 50*a* or 50*b*, and the other one thereof has apertures 55 and 56 for receiving therein the alignment and locking pins 53 and 54. These alignment and locking pins 53 and 54, as described above, also function to align the insert between the complementary comb members 50*a* and 50*b*.

While the complementary comb members 50*a* and 50*b* forming the combing device 50 can be independent members, preferably and advantageously the comb members 50*a* and 50*b* are molded as an integral unit, with the teeth 52*a* and 52*b* thereof integrally affixed together by means of a flexible web or hinge 57 at the terminal ends of the teeth.

As in the case of the combing device 10 and the combing device 40, an insert is disposed between the comb members 50*a* and 50*b*, by extending the alignment and locking pins 53 and 54 through the apertures formed in the insert, and then the comb members 50*a* and 50*b* are folded together, by means of the flexible web or hinges 57, to secure the comb members 50*a* and 50*b* together, as illustrated in FIG. 10. The comb members 50*a* and 50*b* are releasably and lockingly secured together by means of the alignment and locking pins 53 and 54 being frictionally or lockingly received within the apertures 55 and 56.

Figure 11:
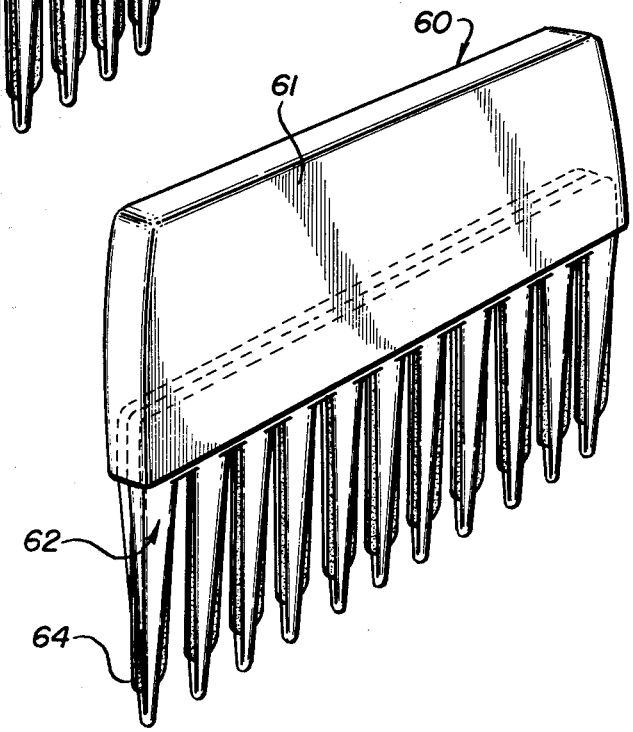
FIG. 11 is a perspective view generally illustrating the combing device constructed in accordance with still another embodiment of the invention, wherein the protective cover performs the dual function of a cover and a handle for the comb.

In FIG. 11, there is illustrated still another combing device 60 formed in accordance with still another embodiment of the invention. In this case, the combing device 60 includes a comb 62 which can be of a construction as described above in the case of the combing devices 10 and 40, however, a dual purpose handle-cover 61 is provided. The dual function handle-cover 61 is adapted to releasably secure the pair of complementary comb members therein, with the insert 64 retained between them, so as to function as a handle, as illustrated in FIG. 11. The handle-cover 61 also functions as a protective cover for the teeth of the comb 62, the comb 62 being reversible so that the teeth can be extended into the handle-cover 61 to protectively enclose them, generally in the manner illustrated in FIGS. 1 and 2.

As can be seen from the description above, a combing device of various different constructions is provided, each of which includes a comb having a number of teeth and being separable along the longitudinal axis thereof so as to be formed by a pair of complementary comb members of a substantially like construction. Also, in each case, an insert of an absorbent material is removably retained between the pair of complementary comb members, and the insert extends laterally from the sides of the respective ones of the teeth so as to provide wiping surfaces between adjacent pairs of the teeth for engaging and thereby conditioning the hair as the combing device is combed through the hair. The insert is formed discontinuous between adjacent pairs of the teeth so as to permit the combing device to be combed through the hair, either by merely forming a slot or slit in the insert between the adjacent pairs of teeth, or by die cutting or otherwise forming the insert to provide a plurality of fingers or teeth which substantially corresponds to the teeth formed on the comb of the combing device. Various constructions also are utilized for releasably securing the pair of complementary comb members together with the insert between them. Further still, the combing device can be provided with a hand grip portion, if desired, and with a protective cover for the comb's teeth. Alternatively, the protective cover for the comb can function both as a handle and as a protective cover for the teeth, as in the case of the embodiment disclosed in FIG. 11. Further still, while the combing device illustrated in FIGS. 9 and 10 is longitudinally separable along the longitudinal axis of both the comb and the handle portion thereof, it is obvious that the comb portion only could be longitudinally separable.

A number of inserts can be packaged and provided for use in combination with the combing device. When the insert becomes dirty, or for other reasons requires replacement, a new insert can be easily and quickly replaced in the combing device, in the manner described.

It also is obvious that the combing device can be utilized without an insert, thus effectively serving a dual function in that it also can be used as an ordinary comb. Further still, a tint, dyeing or other type substance or material can be applied to the insert, for the purpose of conditioning the hair as the combing device is combed through the hair.

Now that the invention has been described, what is claimed as new and desired to be secured by Letters Patent is:

1. A combing device for conditioning hair as the combing device is combed through the hair comprising, in combination: a comb having a plurality of teeth, said comb being separable along the longitudinal axis thereof so as to be formed by a pair of complementary comb members of a substantially like construction, an insert of an absorbent sheet material removably retained between said pair of complementary comb members, said insert being substantially coextensive in length with the length of said teeth and extending laterally from the sides of the respective ones of said plurality of teeth, said insert further being discontinuous between adjacent pairs of said plurality of teeth so as to permit said combing device to be combed through the hair and to provide wiping surfaces between adjacent pairs of said plurality of teeth for engaging and thereby conditioning the hair as the combing device is combed through the hair, and means for releasably securing said pair of complementary comb members together with said insert therebetween.

2. The combing device of claim 1, wherein said means for releasably securing said pair of complementary comb members together comprises complementary interlocking means on the respective ones of said pair of complementary comb members.

3. The combing device of claim 2, wherein said complementary interlocking means comprises pin means on one of said pair of complementary comb members and cooperative aperture means for releasably and lockingly receiving said pin means on the other one of said complementary comb members.

4. The combing device of claim 3, further comprising alignment apertures in said insert adapted to receive therethrough said interlocking pin means to position and align said insert in cooperative relationship with said pair of complementary comb members, said interlocking pin means thereby performing a dual function.

5. The combing device of claim 1, wherein said insert is formed with a plurality of fingers corresponding in number with the teeth on said comb, each of said fingers being substantially coextensive in length with said teeth and being proportioned in width to extend laterally from the opposite sides of the respective one of said plurality of teeth with which it is associated so as to permit said combing device to be combed through the hair and to provide wiping surfaces between adjacent pairs of said plurality of teeth for engaging and thereby conditioning the hair as the combing device is combed through the hair.

6. The combing device of claim 1, further comprising means for securing said insert against displacement between said teeth provided on at least the tooth portion of at least one of said pair of complementary comb members.

7. The combing device of claim 6, wherein said means for securing said insert against displacement comprises a plurality of barb-like members.

8. The combing device of claim 1, wherein said pair of complementary comb members are hinged together to permit them to be pivotally manipulated to removably secure said insert between them.

9. The combing device of claim 1, wherein said pair of complementary comb members are molded of a plastic material with the terminal ends of said plurality of teeth being integrally affixed together with a flexible web of plastic material which forms a living, flexible hinge to permit said pair of complementary comb members to be pivotally manipulated to removably secure said insert between them.

10. The combing device of claim 1, further comprising a removably replaceable protective cover for said plurality of teeth.

11. The combing device of claim 1, wherein said means for releasably securing said pair of complementary comb members together comprises a removably replaceable protective cover for said plurality of teeth, said cover being removable and formed to receive therein a portion of said pair of complementary comb members to secure them together with said plurality of teeth exposed.

12. The combing device of claim 1, wherein said means for releasably securing said pair of complementary comb members together comprises a handle means having a cavity formed therein proportioned to removably and frictionally lockingly secure said pair of complementary comb members therein.

13. The combing device of claim 12, further comprising alignment pin means on at least one of said pair of complementary comb members and cooperative aperture means for receiving said pin means on the other one of said pair of complementary comb members, said insert having alignment apertures formed therein for receiving therethrough said pin means for positioning and aligning said insert in cooperative relationship with said pair of complementary comb members.

14. The combing device of claim 12, further comprising a removable protective cover for said plurality of teeth.

15. The combing device of claim 1, wherein said means for releasably securing said pair of complementary comb members together comprises a handle means having a cavity formed therein proportioned to removably receive said pair of complementary comb members therein, said cavity having at least one end thereof which is open to permit said pair of complementary comb members to be slidably inserted into said cavity through said open end.

16. The combing device of claim 15, further comprising complementary guide means on said pair of complementary comb members and within said cavity for guiding said comb into said cavity.

17. The combing device of claim 16, further comprising means for releasably securing said comb within said cavity.

18. The combing device of claim 15, further comprising a removable protective cover for said plurality of teeth.

19. The combing device of claim 1, further comprising an elongated handle means on said comb.

20. The combing device of claim 19, wherein said comb including said elongated handle means is separable along the longitudinal axis thereof.

21. The combing device of claim 20, further comprising a removable protective cover for said plurality of teeth.

22. In combination, a combing device and an absorbent insert for said combing device, said combing device comprising a comb which has a plurality of teeth and which is separable along the longitudinal axis thereof so as to be formed by a pair of complementary comb members of a substantially like construction, and means for releasably securing said pair of complementary comb members together; and said insert comprising an absorbent sheet material which is removably retained between said pair of complementary comb members and which is proportioned to be substantially coextensive in length with the length of said teeth and to extend laterally from the sides of the respective ones of said plurality of teeth of said comb, said insert further being discontinuous between adjacent pairs of said plurality of teeth so as to permit said combing device to be combed through the hair and to provide wiping surfaces between adjacent pairs of said plurality of teeth for engaging and thereby conditioning the hair as the combing device is combed through the hair.

23. The combination of claim 23, wherein said absorbent insert is substantially coextensive in area with that of said comb and is slit so as to be discontinuous at least between adjacent pairs of said plurality of teeth to permit said combing device to be combed through the hair and to provide wiping surfaces between adjacent pairs of said plurality of teeth.

24. The combination of claim 22, wherein said insert is formed with a plurality of fingers corresponding in number with the teeth on said comb, each of said fingers being substantially coextensive in length with said teeth and being proportioned in width to extend laterally from the opposite sides of the respective one of said plurality of teeth with which it is associated so as to permit said combing device to be combed through the hair and to provide wiping surfaces between adjacent pairs of said plurality of teeth for engaging and thereby conditioning the hair as the combing device is combed through the hair.

25. An insert for use with a combing device of the type including a comb having a plurality of teeth, the comb being separable along the longitudinal axis thereof so as to be formed by a pair of complementary comb members of a substantially like construction and means for releasably securing said pair of complementary comb members together, said insert comprising an absorbent sheet material and being proportioned for removable retainment between said pair of complementary comb members and to extend laterally from the sides of the respective ones of said plurality of teeth of the comb, said insert further being substantially coextensive in length with the length of said teeth discontinuous between adjacent pairs of said plurality of teeth so as to permit said combing device to be combed through the hair and to provide wiping surfaces between adjacent pairs of said plurality of teeth for engaging and thereby conditioning the hair as the combing device is combed through the hair.

26. The insert of claim 25, being substantially coextensive in area with that of the comb and being slit so as to be discontinuous at least between adjacent pairs of the plurality of teeth to permit the combing device to be combed through the hair and to provide wiping surfaces between adjacent pairs of plurality of teeth.

27. The insert of claim 25, being formed with a plurality of fingers corresponding in number with the teeth on the comb, each of said fingers being substantially coextensive in length with the teeth and being proportioned in width to extend laterally from the opposite sides of the respective one of the plurality of teeth with which it is associated so as to permit the combing device to be combed through the hair and to provide wiping surfaces between adjacent pairs of the plurality of teeth for engaging and thereby conditioning the hair as the combing device is combed through the hair.

28. The insert of claim 22 further comprising alignment apertures therein adapted to receive therethrough pin means on at least one of the complementary comb members to position and align said insert in cooperative relationship with the pair of complementary comb members.

* * * * *